United States Patent [19]

Engelman

[11] 4,011,953

[45] Mar. 15, 1977

[54] SPECTACLE RACK

[76] Inventor: Stefan Engelman, 61-38 164th St., Flushing, N.Y. 11365

[22] Filed: Aug. 15, 1975

[21] Appl. No.: 606,342

[52] U.S. Cl. ..... 211/13; 248/122; 248/172; 248/DIG. 2

[51] Int. Cl.[2] ..... A47F 7/00

[58] Field of Search ..... 248/DIG. 2, 121–127, 248/205 R, 163, 172, 176, 274, 276, 298, 316 A, 300, 23, 149, 252, 256, 304; 211/13, 17–24; 351/155, 38; 206/5

[56] References Cited

UNITED STATES PATENTS

| | | | |
|---|---|---|---|
| 848,850 | 4/1907 | Pissahl | 248/172 X |
| 1,686,993 | 10/1928 | Suter | 248/23 |
| 2,503,801 | 4/1950 | Clarke | 248/122 X |

FOREIGN PATENTS OR APPLICATIONS

| | | | |
|---|---|---|---|
| 1,446,156 | 6/1966 | France | 248/172 |
| 9,327 | 4/1897 | United Kingdom | 211/17 |

*Primary Examiner*—Roy D. Frazier
*Assistant Examiner*—Terrell P. Lewis

[57] ABSTRACT

A spectacle rack that is supported by a base and in addition to being functional is aesthetically attractive.

5 Claims, 4 Drawing Figures

SPECTACLE RACK

BACKGROUND OF THE INVENTION

This invention relates to a spectacle holder; more particularly, the invention relates to an aesthetically pleasing and ornamental holder or rack.

Eyeglasses are often damaged or broken by the wearer placing them down without putting them in their case. For example, when working at a desk or the like, one does not desire to put the eyeglasses away, but merely remove them from the head. It is for this purpose that the instant invention is eminently suitable.

The prior art teaches a variety of spectacle holders and the like, for example, U.S. Pat. Nos.: 2,411,361; 2,467,251; 2,958,495; 2,991,967; 3,259,348; 3,291,429; 3,519,138; 3,552,701; and others.

SUMMARY OF THE INVENTION

It is accordingly an object of the instant invention to provide for an improved spectacle rack.

It is another object of the invention to provide for the same at relatively little cost thereby making the same generally available.

These as well as other objects of the invention will become more apparent from the following detailed disclosure and claims and by reference to the accompanying drawings, in which:

Figure 1:
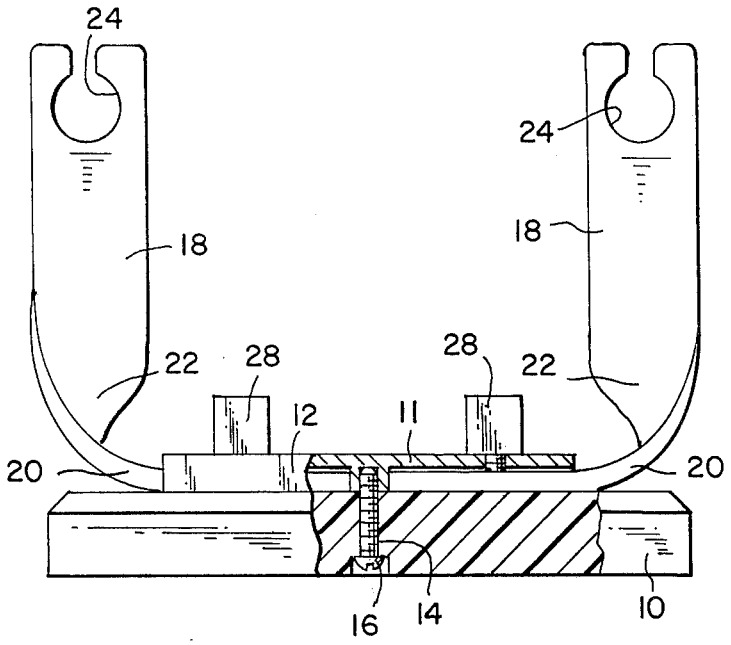
FIG. 1 is a front elevational view of a rack in accordance with the invention.
Figure 2:
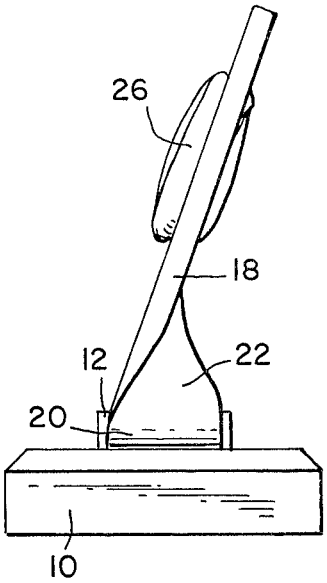
FIG. 2 is a side elevational view thereof.
Figure 3:
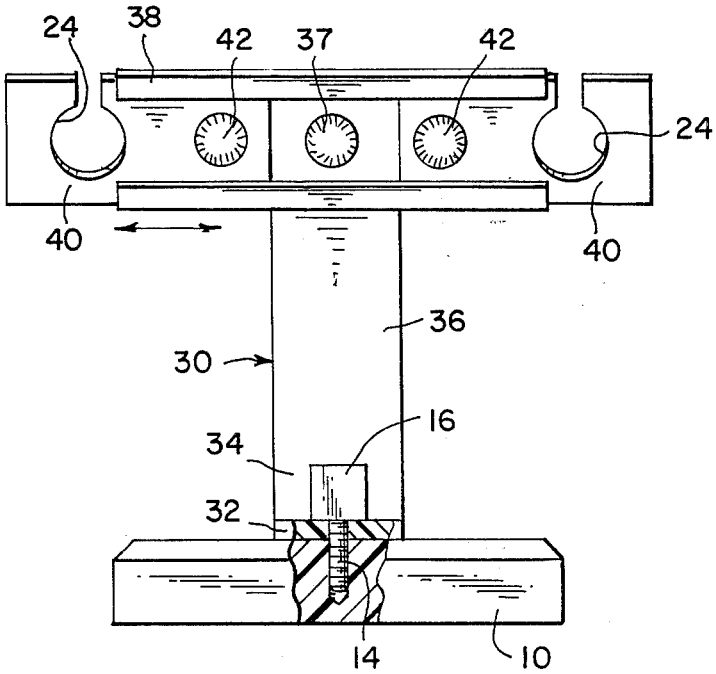
FIG. 3 is a front elevational view of another embodiment.
Figure 4:
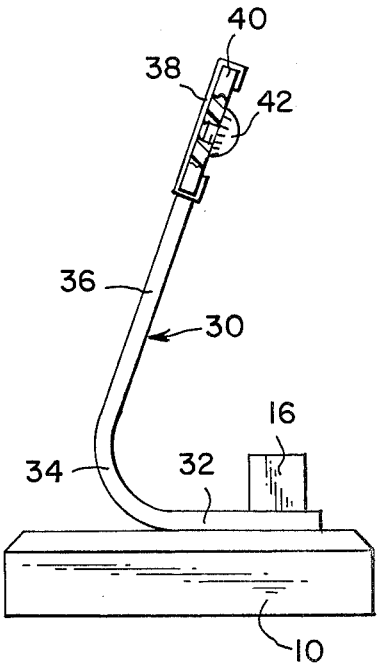
FIG. 4 is a side elevational view thereof.

Broadly speaking, the instant invention includes the provision of a spectacle holder for holding a pair of spectacles, comprising a substantial horizontally disposed base portion, a slotted channel integral with and horizontally disposed on the base portion, a pair of upright arms having base portions adapted to slide independently in the channel and an aperture in each of the arms each adapted to receive a portion of the spectacles, the apertures being in coaxial alignment.

DETAILED DISCLOSURE

Referring more particularly to the drawings in which elements are designated by like numerals, there is shown a eyeglass rack that includes a base portion 10 that in the preferred embodiment is substantially planar and predominently rectangular in shape, though it need not be. One embodiment of the invention provides for a slotted channel 12 that rests in planar alignment with the horizontal axis of the base. An internally threaded aperture 14 is disposed in the base 10 and communicates with the channel 12. An externally threaded screw 16 is provided to anchor the channel 12 to the base 10. Alternatively, the channel 12 can be integral to the base 10 by any suitable means, adhesion, etc. A pair of vertically disposed arms 18 having substantially horizontal base portions 20 are adapted to engage the slotted channel 12. In the preferred embodiment each arm 18 will have a twist at the arcuate section 22 where the same begins its horizontal disposition. Each arm 18 near its distal end will also define a (key hole) opening 24 that is adapted to receive the temple of the eyeglasses 26 therein. The arms 18 are adapted to slide in opposition to each other, towards and away from each other such that the temples of varying size glasses 26 may be accommodated. At least one, preferably two members, i.e., clamp screws 28 or the like are provided to maintain the position of the arms 18 at any given setting. The members 28 communicate between one side 11 of the channel 12 and the horizontal portion 20 of the arm 18 such that pressure is exerted thereon.

A further embodiment contemplates a base portion 10 and a substantially arcuate shaped upright member 30 that includes a substantially horizontal portion 32 in planar alignment with the substantially horizontally disposed base 10, an arcuate shaped intermediate section 34 that rises upwardly to form an inclined upright arm 36. The upright distal end of the arm 36 will include a slotted channel 38 that is disposed perpendicular to the arm 36. The channel 38 is integral with the arm 36 such as by screw means 37 or the like, i.e., adhesion. Disposed in the channel 36 there will be a pair of horizontally aligned members 40 that define apertures 24 (key hole), members 40 are adapted to oppose each other, (slide towards and away from) such that varying eyeglass 26 widths may be accommodated. Members 40 are preferably rectangularly shaped and will include at least one, preferably two means 42 that are adapted to secure the members 40 at any given setting. For example, clamp screws that communicate between one surface of the channel and both surfaces of the member 40 by passing through an aperture therein.

Since it is obvious that numerous changes and modifications can be made in the above described details without departing from the spirit and nature of the invention, it is to be understood that all such changes and modifications are included within the scope of the invention.

I claim:

1. A spectacle holder for holding a pair of spectacles comprising, a substantially horizontally disposed base portion, a slotted channel member integral with and horizontally disposed on the upper surface of said base portion, said channel member defining a slot extending inwardly from opposite ends of said channel member, a pair of arms each having a base portion and an upper portion, each arm base portion adapted to slide independently in said channel member and being slideably mounted within said slot from said opposite ends and an aperture in each of the upper portions of said arms each adapted to receive a portion of said spectacles, said apertures being disposed within the same plane and spaced apart a distance substantially equal to the distance between said upper portions of said arms.

2. The holder as defined in claim 1 and means for securing said arms in any given setting in said channel member.

3. A spectacle holder according to claim 1 further including an arcuate transition piece between each of said base portions of said arms and each of said upper portions.

4. A spectacle holder according to claim 1 wherein said upper portions are parallel and transverse to said arm base portions.

5. A spectacle holder according to claim 1 wherein each of said apertures includes a circular portion and a slot extending from the terminus of said upper portion to said circular portion.

* * * * *